US006042435A

United States Patent [19]

Nakamura

[11] Patent Number: 6,042,435

[45] Date of Patent: Mar. 28, 2000

[54] TILT-TRIM DEVICE FOR MARINE PROPULSION DEVICE

[75] Inventor: Tamotsu Nakamura, Saitama, Japan

[73] Assignee: Showa Corporation, Saitama, Japan

[21] Appl. No.: 09/048,449

[22] Filed: Mar. 26, 1998

[30] Foreign Application Priority Data

Mar. 26, 1997 [JP] Japan ..... 9-090040

[51] Int. Cl.[7] ..... B63H 5/125

[52] U.S. Cl. ..... 440/61; 440/900

[58] Field of Search ..... 92/51–53; 440/61, 440/53, 900

[56] References Cited

U.S. PATENT DOCUMENTS 5,149,285 9/1992 Kinoshita ..... 440/61

FOREIGN PATENT DOCUMENTS 6344982 12/1994 Japan .

*Primary Examiner*—Ed Swinehart

*Attorney, Agent, or Firm*—Dvorak & Orum

[57] ABSTRACT

The present invention provides a tilt-trim device for a marine propulsion unit comprising a hydraulic cylinder device where a hydraulic fluid is filled in a cylinder formed in a cylinder housing and a buffer piston connected to one end of a piston rod is provided slidably so as to divide the inside of the cylinder into a piston side space and a rod side space, a boosting housing provided slidably at the outer periphery of the cylinder housing for forming a boosting space with the cylinder housing, capable of contacting the piston rod, and a hydraulic fluid supplying and exhausting device provided integrally with the cylinder housing, for supplying the hydraulic fluid alternatively to the piston side space and the boosting space or the rod side space for projecting or storing the piston rod from or to the cylinder housing, where the boosting housing contacts the piston rod by the supply of the hydraulic fluid from the hydraulic fluid supplying and exhausting device to the boosting space for applying the pressure in the projecting direction on the piston rod, wherein a boosting path for communicating the hydraulic fluid supplying and exhausting device and the boosting space is formed inside the cylinder housing.

6 Claims, 6 Drawing Sheets

TILT-TRIM DEVICE FOR MARINE PROPULSION DEVICE

BACKGROUND OF THE INVENTION

1. Field of the Invention

The present invention relates to a tilt-trim device for a marine propulsion unit preferably used in an outboard motor or an inboard engine.

2. Description of the Prior Art

A marine propulsion device such as an outboard motor includes a propulsion unit comprising a propeller and an engine supported axially by a swivel bracket such that a horizontal swinging movement is allowed, with the swivel bracket being supported by a clamp bracket to provided a vertical tilting movement, with the clamp bracket gripping the hull. A tilt-trim device is provided between the clamp bracket and the swivel bracket such that the propulsion unit and the swivel bracket are tilted vertically with respect to the clamp bracket by a telescopic motion of a hydraulic cylinder of the tilt-trim device, so as to allow tilt or trim operation of the propulsion unit.

As an example of a tilt device, Japanese Patent Application Laid-Open (JP-A) No. 6-344982 discloses one having a piston connected to one end of a piston rod provided slidably in a cylinder of a cylinder housing such that the inside of the cylinder is divided into a piston side space and a rod side space. A boosting housing is provided slidably at the outer periphery of the cylinder housing so that the boosting housing forms a boosting space and contacts with the piston rod for supplying a hydraulic fluid from a hydraulic fluid supplying and exhausting device to a piston side space and the boosting space for the trim-up and tilt-up operation of the propulsion unit, and for supplying the hydraulic fluid from the hydraulic fluid supplying and exhausting device to a rod side space for the tilt-down and trim-down operation of the propulsion unit.

In the prior art referred to hydraulic fluid is supplied to the piston side space for applying pressure to the piston rod toward the projecting direction via the piston as well as the boosting housing contacts with the piston rod by the hydraulic fluid supply to the boosting space for applying pressure also to the piston rod toward the projecting direction so that the sum of the pressure functions on the piston rod as a large trim-up force.

However, in this prior art, since the channel for supplying and exhausting hydraulic fluid from the hydraulic fluid supplying and exhausting device to the boosting space is exposed outside, the exposed piping prevents downsizing of the tilt-trim device.

SUMMARY OF THE INVENTION

In order to cope with the above-mentioned conventional problems, an object of the present invention is to provide a tilt-trim device for a marine propulsion device for providing a large trim-up power in a compact configuration, capable of preventing damage of the device, in particular, in a duct.

The tilt-trim device for a marine propulsion unit of the present invention for the tilt operation or the trim operation of the propulsion unit, provided between a mounting bracket for mounting to the hull and a propulsion unit supported tiltably with respect to the mounting bracket, comprises a cylinder device formed in a cylinder housing and filled with a working fluid; a piston connected to one end of a piston rod is provided slidably; the cylinder is divided into a piston side space and a rod side space, and either the cylinder housing or the piston rod is supported by the mounting bracket and the other is supported by the propulsion unit side. A boosting housing, which can contact the piston rod in the rod axis direction, is provided slidably at the outer periphery of the cylinder housing so as to form a boosting space with a liquid-tight structure with the cylinder housing. A working fluid supplying and exhausting device mounted integrally with the cylinder housing, for supplying a working fluid alternatively to the piston side space and the boosting space, or to the rod side space so as to project or store the piston rod from or in the cylinder housing, where the pressure toward the projecting direction is applied to the piston rod by contact with the boosting housing and the piston rod by the supply of the working fluid from the working fluid supplying and exhausting device to the boosting space, where a channel connecting the working fluid supplying and exhausting device and the boosting space is formed inside the cylinder housing.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENTS

Hereinafter embodiments of the present invention will be described with reference to the accompanied drawings.

Figure 1:
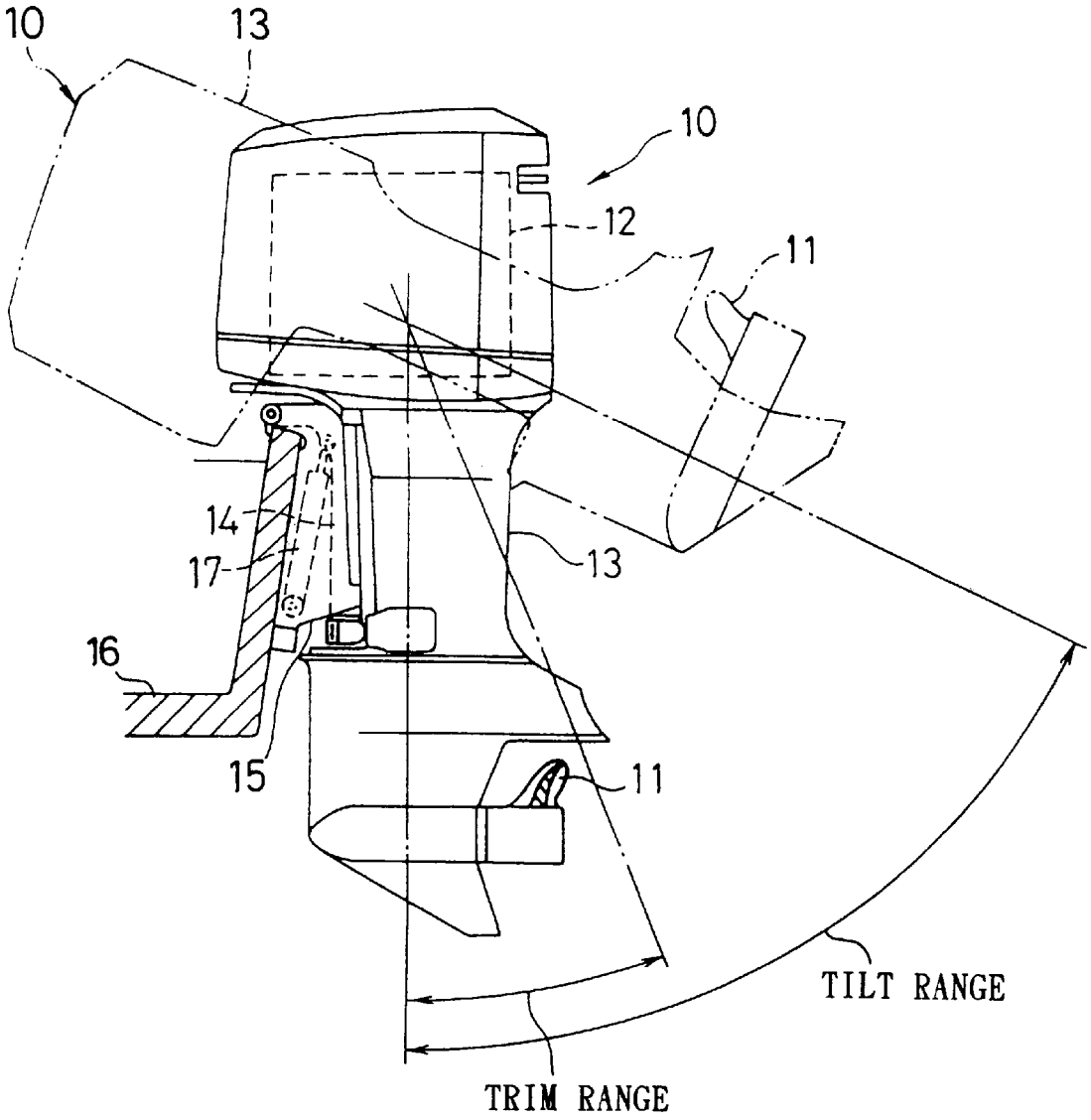
FIG. 1 is a side view of an outboard motor with one embodiment of a tilt-trim device for a marine propulsion device of the present invention.
Figure 2:
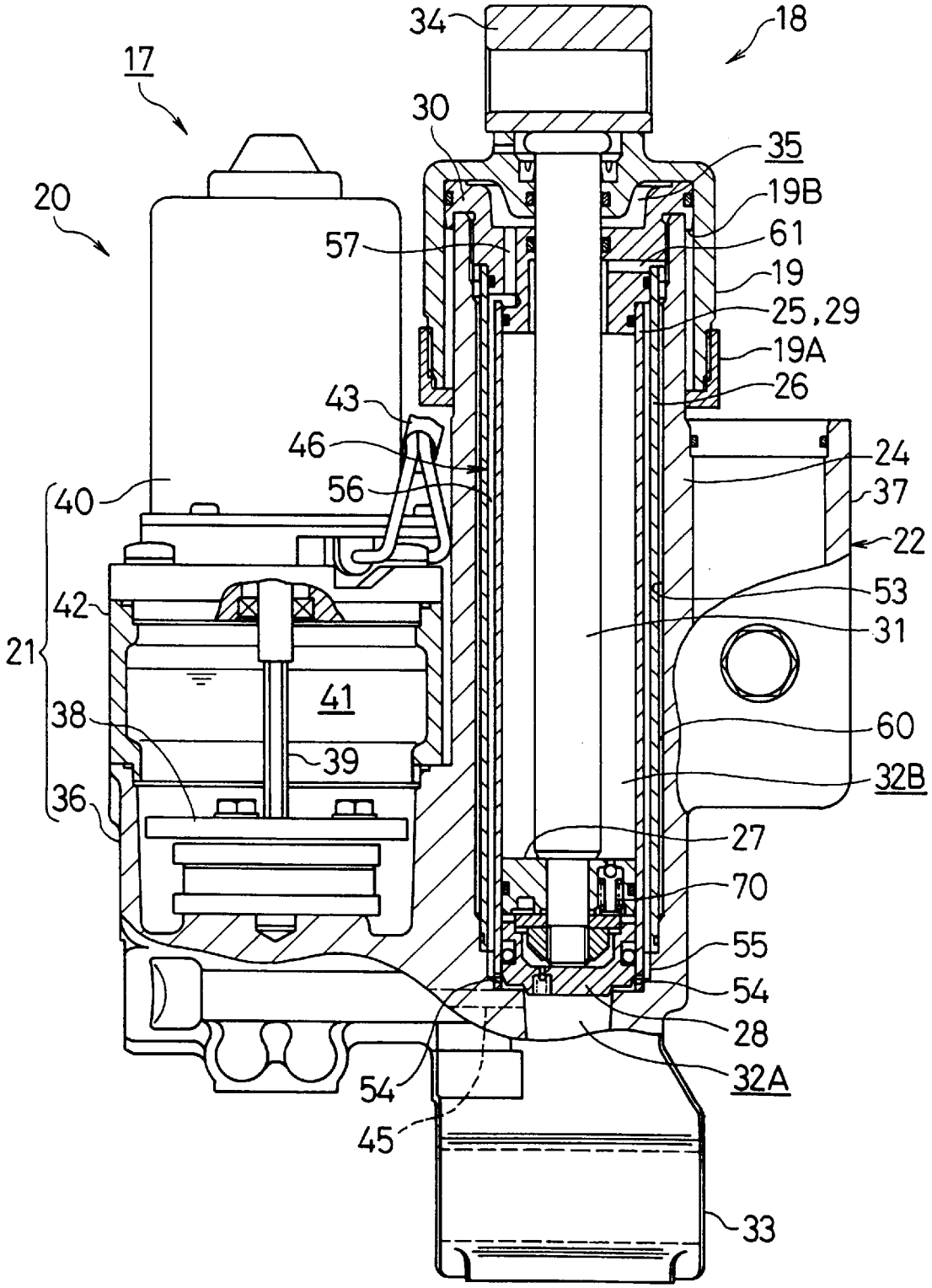
FIG. 2 is a cross-sectional view of the tilt-trim device.
Figure 3:
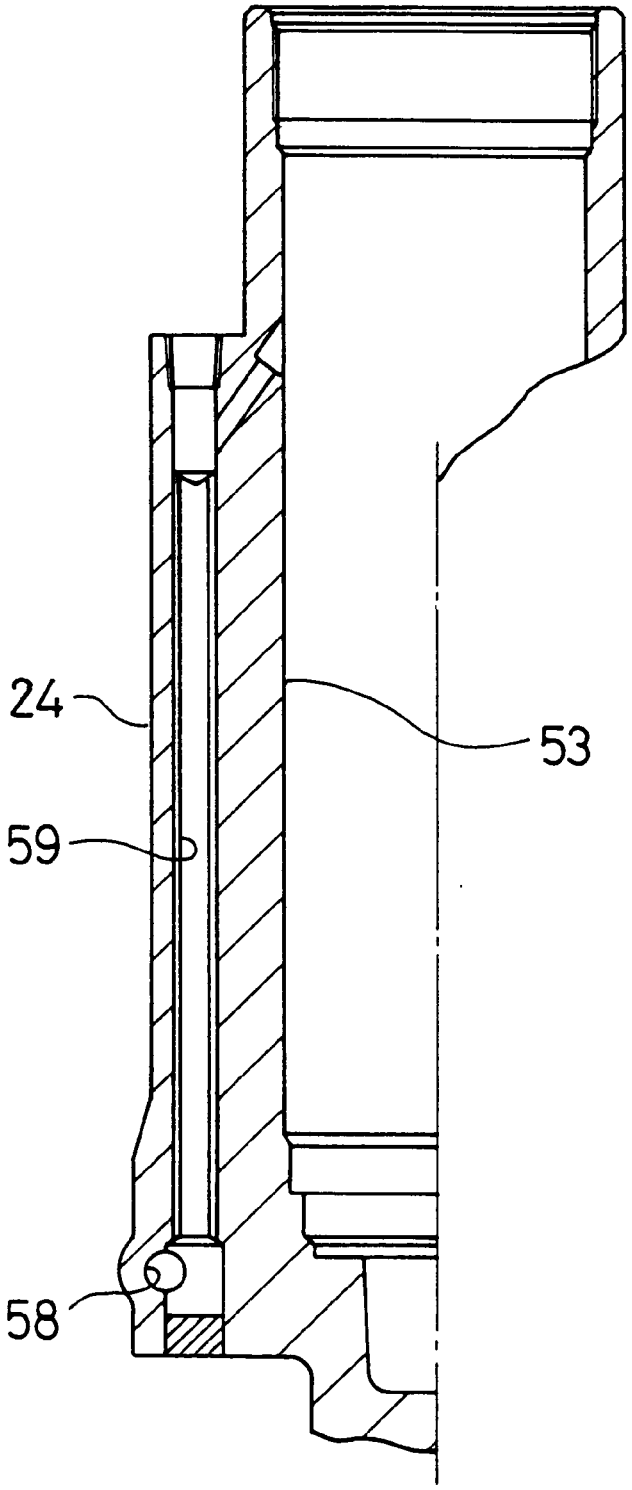
FIG. 3 is a partial cross-sectional view of the cylinder housing.
Figure 4:
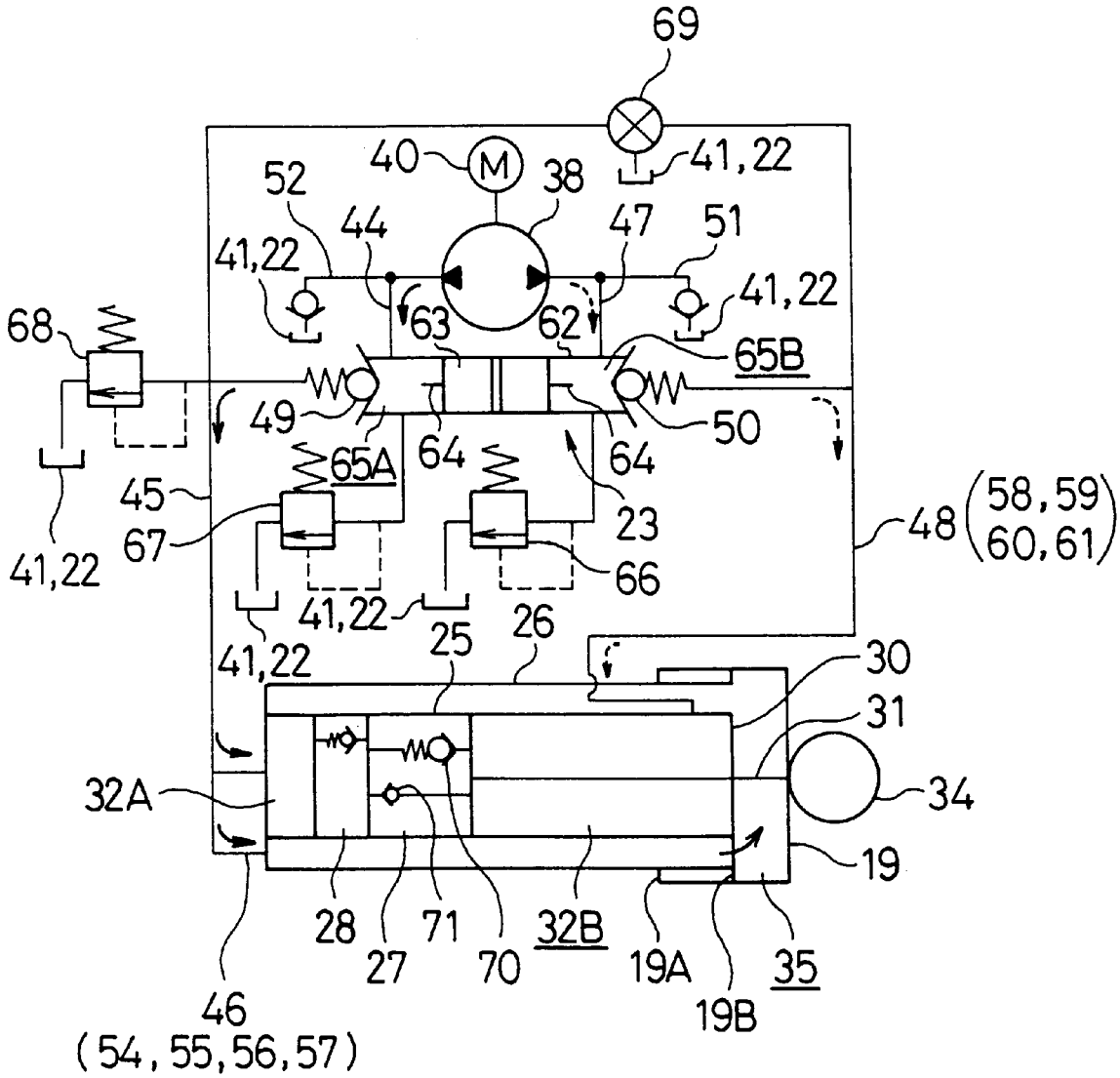
FIG. 4 is a circuit diagram of a hydraulic circuit of the tilt-trim device.
Figure 5:
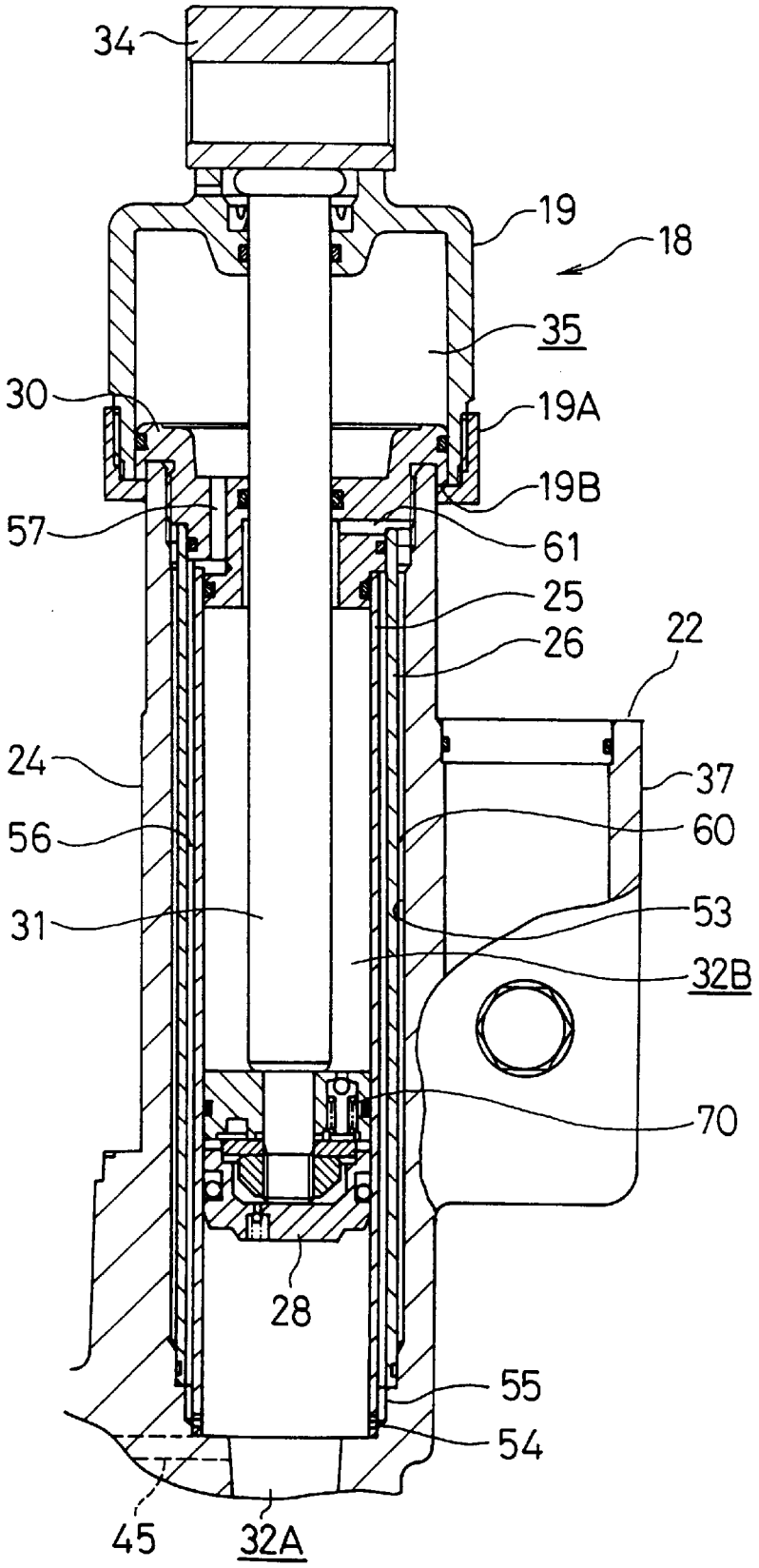
FIG. 5 is a cross-sectional view showing the trim-up operation state of the tilt-trim device.
Figure 6:
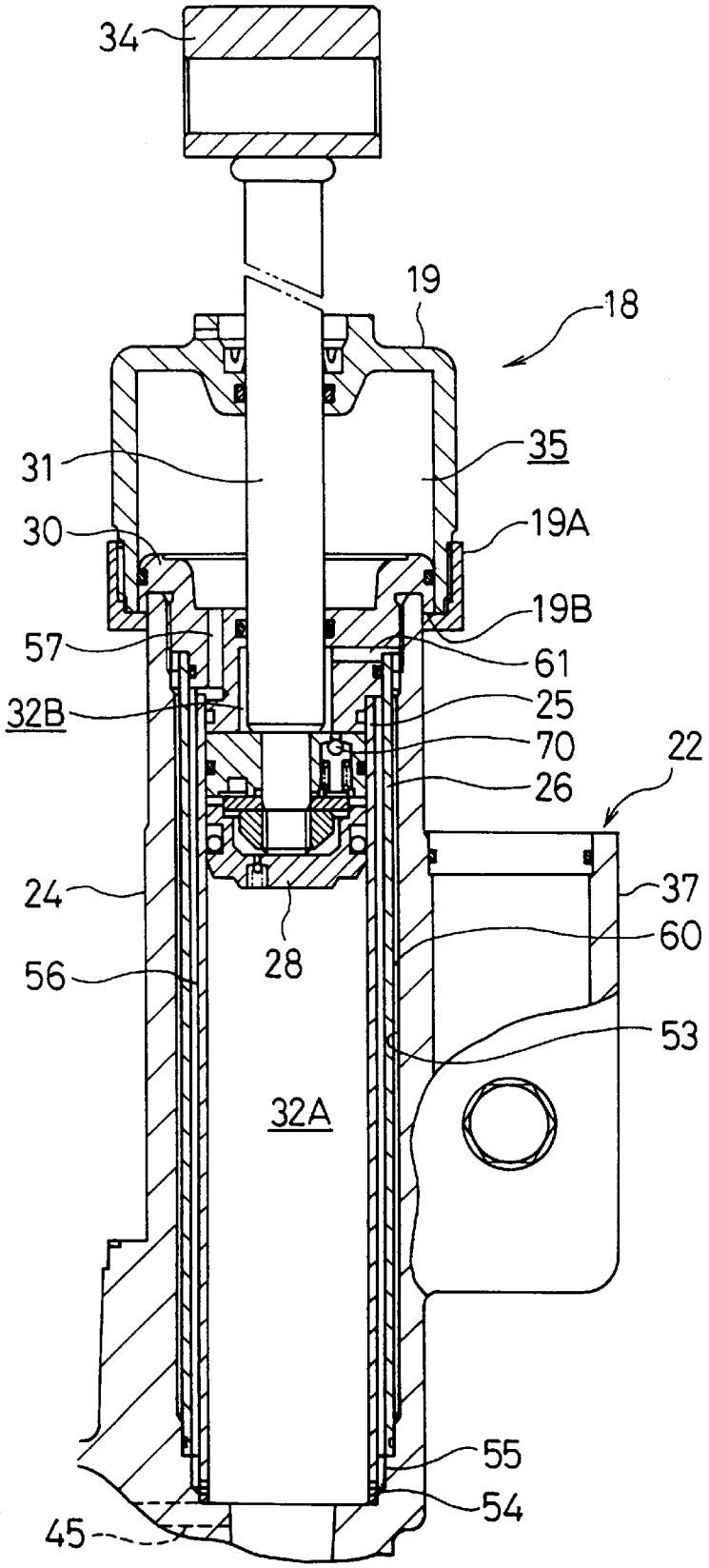
FIG. 6 is a cross-sectional view showing the tilt-up operation state of the tilt-trim device.

FIG. 1 is a side view of an outboard motor with one embodiment of a tilt-trim device for a marine propulsion device of the present invention. FIG. 2 is a cross-sectional view of the tilt-trim device. FIG. 3 is a partial cross-sectional view of the cylinder housing. FIG. 4 is a circuit diagram of a hydraulic circuit of the tilt-trim device. FIG. 5 is a cross-sectional view showing the trim-up operation state of the tilt-trim device. FIG. 6 is a cross-sectional view showing the tilt-up operation state of the tilt-trim device.

As shown in FIG. 1, an outboard motor 10 as the marine propulsion device comprises a propulsion unit 13 comprising a propeller 11 and an engine 12, supported axially by a swivel bracket 14 to allow a horizontal swinging movement. The swivel bracket 14 is supported by a clamp bracket 15 such that vertical tilting movement is allowed. Since the clamp bracket 15 grips the hull 16 so as to be fixed to the hull 16, the propulsion unit 13 can swing horizontally and tilt vertically with respect to the hull 16. By forward or reverse rotation of the propeller 11 of the outboard motor 10 by the engine 12, the hull 16 moves forward or backward.

A tilt-trim device 17 is provided between the swivel bracket 14 and the clamp bracket 15 of the outboard motor 10. The tilt operation or the trim operation of the propulsion unit 13 of the outboard motor 10 is conducted by the telescopic motion of the tilt-trim device 17. The trim operation refers to the operation of adjusting the angle of the propulsion unit 13 resisting to the thrust of the propeller 11 during the sailing of the hull 16 so as to change the sailing posture of the hull 16. The tilt operation refers to the operation of tilting the propulsion unit 13 resisting to the self-weight the hull 16 is stopped so as to raise the propulsion unit 13 above water.

As shown in FIGS. 2 and 4, the tilt-trim device 17 comprises a hydraulic cylinder device 18, a boosting housing 19 and a hydraulic fluid supplying and exhausting device 20. The hydraulic fluid supplying and exhausting device 20 comprises a pump device 21, a tank device 22 and a shuttle valve device 23.

As shown in FIGS. 2 to 4, the hydraulic cylinder device 18 has an inner sleeve 25 and an outer sleeve 26 in a cylinder housing 24, with the inner sleeve 25 comprising a cylinder 29 where a buffer piston 27 and a free piston 28 can slide therein. The inner sleeve 25 and the outer sleeve 26 are produced with a drawn pipe material with inside and outside mirror processing.

The open end of the cylinder housing 24 is closed with a rod guide 30, with the inner sleeve 25 and the outer sleeve 26 interposed and supported between the rod guide 30 and the closed end side of the cylinder housing 24. One end of a piston rod 31 is connected to the buffer piston 27, with the piston rod 31 piercing through the rod guide 30 liquid-tightly. Furthermore, the buffer piston 27 and the free piston 28 divide the inside of the cylinder 29 (inner sleeve 25) into a rod side space 32B for accommodating the piston rod 31 and a piston side space 32A not for accommodating the piston rod 31. The piston side space 32A and the rod side space 32B are filled with a hydraulic fluid.

The buffer piston 27 is provided with a buffer valve 70 and a return valve 71 (FIG. 4). The buffer valve 70 is for exhausting the hydraulic fluid in the rod side space 32B into the piston side space 32A (the fluid space surrounded by the buffer piston 27 and the free piston 28 in the inner sleeve 25) for absorbing the collision energy by the resistance of the hydraulic fluid flowing in the buffer valve 70 to alleviate the impact when the propulsion unit 13 collides with driftwood during the sailing of the hull 16 so that the pressure in the rod side space 32B exceeds a predetermined value. The return valve 71 serves to have the buffer piston 27 returned to a predetermined position by the self-weight of the propulsion unit 13 after absorbing an impact by allowing the flow of the hydraulic fluid from the piston side space 32A (the fluid space surrounded by the buffer piston 27 and the free piston 28 in the inner sleeve 25) to the rod side space 32B.

A shaft supporting portion 33 is formed in the cylinder housing 24 of the hydraulic cylinder device 18 so that the cylinder housing 24 is supported by the clamp bracket 15 via the shaft supporting portion 33. A shaft supporting portion 34 is provided at the other end of the piston rod 31 of the hydraulic cylinder device 18 so that the shaft supporting portion 34 is supported axially by the swivel bracket 14. Accordingly, by the supply of a hydraulic fluid from the pump device 21 to the piston side space 32A of the hydraulic cylinder device 18, the hydraulic cylinder device 18 contracts, that is, the piston rod 31 projects from the cylinder housing 24 (extension of the hydraulic cylinder device 18) and the hydraulic fluid is supplied from the pump device 21 to the rod side space 32B so that the piston rod 31 is stored inside the cylinder housing 24 (contraction of the hydraulic cylinder device 18).

The boosting housing 19 is provided at the outer periphery of the open end side of the cylinder housing 24 and at the outer periphery of the piston rod 31 slidably and liquid-tightly so as to form the boosting space 35 with the rod guide 30 and the piston rod 31. Furthermore, the boosting housing 19 can contact the shaft supporting portion 34 of the piston rod 31. When the hydraulic fluid is supplied from the pump device 21 to the piston side space 32A of the hydraulic cylinder device 18 so that the piston rod 31 projects from the cylinder housing 24, the hydraulic fluid is supplied from the pump device 21 and to the boosting space 35 simultaneously (to be explained in detail later) so that the boosting housing 19 contacts the shaft supporting portion 34 of the piston rod 31 and applies pressure in the projecting direction to the piston rod 31.

A stopper ring 19A is attached to a lower part of the boosting housing 19. On the other hand, a stopper portion 19B is formed in the rod guide 30, protruding from the outer periphery of the cylinder housing 24. When the hydraulic fluid is supplied to the boosting space 35, the stopper ring 19A contacts with the stopper portion 19B as shown in FIG. 5 so as to limit the movement of the boosting housing 19 toward the projecting direction of the piston rod 31.

The pump device 21 of the hydraulic fluid supplying and exhausting device 20 shown in FIG. 2 comprises a first pump case 36 accommodating a gear pump 38 therein, a motor 40 for driving the gear pump 38 in the forward or reverse direction, and a second pump case 42 for providing an fluid storage space 41 for storing the hydraulic fluid with the first pump case 36. The rotation driving power of the motor 40 is transmitted to the gear pump 38 via the shaft 39.

The tank device 22 of the hydraulic fluid supplying and exhausting device 20 comprises a tank case 37 capable of storing the hydraulic fluid. The tank case 37 and the first pump case 36 are formed integrally with the cylinder housing 24 of the hydraulic cylinder device 18.

The second pump case 42 of the pump device 21 is integrally attached to the first pump case 36 fluid-tightly, and the motor 40 is fixed to the second pump case 42 similarly fluid-tightly. The fluid storage space 41 communicates with the inside of the tank case 37 of the tank device 22 via a communication path (not illustrated). The numeral 43 in FIG. 2 denotes an electric cable for supplying electric power to the motor 40.

As shown in FIG. 4, the gear pump 38 of the pump device 21 is connected with the piston side space 32A of the hydraulic cylinder device 18 via the first piston side space side channel 44, the piston side space side check valve 49 of the shuttle valve device 23, and the second piston side space side channel 45, as well as connected with the boosting space 35 via the boosting channel 46. The gear pump 38 is connected with the rod side space 32B of the hydraulic cylinder device 18 via the first rod side space side channel 47, the rod side space side check valve 50 of the shuttle valve device 23, and the second rod side space side channel 48. Furthermore, the gear pump 38 is connected with the fluid storage space 41 via the first fluid storage channel 51 and the second fluid storage channel 52, and connected with the tank device 22 via the above-mentioned communication path.

The configuration of the above-mentioned channel is as follows.

As shown in FIG. 2, the first piston side space side channel 44 and the second piston side space side channel 45 are formed through the integrally-formed first pump case 36 and cylinder housing 24 (only the second piston side space side channel 45 is shown in FIG. 2). The boosting channel 46 formed in the cylinder housing 24, comprises an opening 54, a boosting housing path 55, a first space 56 and a first rod guide path 57. The opening 54 is formed in the piston side space 32A side end portion of the inner sleeve 25, communicating with the piston side space 32A. The boosting housing path 55 is formed in the cylinder housing 24, communicating with the opening 54. The first space 56 is formed between the inner sleeve 25 and the outer sleeve 26, communicating with the boosting housing path 55. The first rod guide path 57 is provided through the rod guide 30, communicating with the first space 56 and the boosting space 35.

Furthermore, although it is not shown in the drawing, the first rod side space side channel 47 is formed through the first pump case 36. The second rod side space side channel 48 formed inside the pump case 36 and the cylinder housing 24, comprises a pump case path 58, a housing path 59, a second space 60 and a second rod guide path 61. As shown in FIG. 3, the pump case path 58 is formed through the first pump case 36, communicating with the rod side space side check valve 50. The housing path 59 is formed through the cylinder housing 24, elongating in the longitudinal direction of the cylinder housing 24 and communicating with the pump case path 58. As shown in FIG. 2, the second space 60 is formed between the outer sleeve 26 and the inside 53 of the cylinder housing 24, communicating with the housing path 59. The second rod guide path 61 is formed through the rod guide 30, communicating with the second space 60 and the rod side space 32B. Since the gear pump 38 is stored inside the fluid storage space 41, the first fluid storage channel 51 and the second fluid storage channel 52 do not exist in this embodiment.

As shown in FIG. 4, the shuttle valve device 23 of the hydraulic fluid supplying and exhausting device 20 comprises a shuttle cylinder 62 between a piston side space side check valve 49 and a rod side space side check valve 50, with a spool 63 stored slidably in the shuttle cylinder 62. Pressers 64 for pressing and opening the piston side space side check valve 49 and the rod side space side check valve 50 are provided protruding at the both ends of the spool 63. The inside of the shuttle cylinder 62 is divided by the spool 63 into a piston side space side fluid space 65A and a rod side space side fluid space 65B.

By the shuttle valve device 23, the hydraulic fluid is supplied alternately from the gear pump 38 to the piston side space 32A of the hydraulic cylinder device 18 and the boosting space 35 of the boosting housing 19, or the rod side space 32B of the hydraulic cylinder device 18 so that the piston rod 31 is projected or stored with respect to the cylinder housing 24.

When the gear pump 38 rotates in the forward direction, the gear pump 38 guides the hydraulic fluid in the fluid storage space 41 and the tank device 22 into the piston side space side fluid space 65A of the shuttle valve device 23 via the first tank channel 51 and the first piston side space side channel 44 as shown by the solid arrow in FIG. 4. The hydraulic fluid guided into the piston side spool 63 toward the rod side space side check valve 50. According to the opening of the piston side space side check valve 49, as shown by the solid arrow in FIG. 4, the hydraulic fluid in the piston side space side fluid space 65A reaches into the piston side space 32A of the hydraulic cylinder device 18 via the second piston side space side channel 45, and to the boosting space 35 via the opening 54, the boosting housing path 55, the first space 56 and the first rod guide path 57 of the boosting channel 46 as shown in FIG. 2. The hydraulic fluid in the rod side space 32B shown in FIG. 4 is returned to the gear pump 38 via the second rod side space side channel 48 (the second rod guide path 61, the second space 60, the housing path 59 and the pump case path 58 shown in FIGS. 2 and 3), the rod side space side check valve 50 (opened state) and the first rod side space side channel 47. As a result, the piston rod 31 of the hydraulic cylinder device 18 moves in the direction so as to project from the cylinder housing 24 and to extend the hydraulic cylinder device 18. Therefore the trim-up and tilt-up operation of the propulsion unit 13 can be conducted.

When the gear pump 38 rotates in the reverse direction, the gear pump 38 guides the hydraulic fluid in the fluid storage space 41 and the tank device 22 into the rod side space side fluid space 65B of the shuttle valve device 23 via the second fluid storage channel 52 and the first rod side space side channel 47 as shown by the broken arrow in FIG. 4. The hydraulic fluid introduced into the rod side space side fluid space 65B opens the rod side space side check valve 50 as well as opens the piston side space side check valve 49 by the presser 64 by moving the spool 63 toward the piston side space side check valve 49. The hydraulic fluid in the rod side space side fluid space 65B reaches to the rod side space 32B of the hydraulic cylinder device 18 via the pump case path 58, the housing path 59, the second space 60 and the second rod guide path 61 of the second rod side space side channel 48 shown in FIGS. 2 and 3 as shown by the broken arrow in FIG. 4. The hydraulic fluid in the piston side space 32A shown in FIG. 4 is returned to the gear pump 38 via the second piston side space side channel 45, the piston side space side check valve 49 (opened state) and the first piston side space side channel 44. Furthermore, the hydraulic fluid in the boosting space 35 reaches the piston side space 32A via the boosting channel 46 (the first rod guide path 57, the first space 56, the boosting housing path 55 and the opening 54 shown in FIG. 2), and is returned similarly to the gear pump 38 via the second piston side space side channel 45, etc. As a result, the piston rod 31 of the hydraulic cylinder device 18 withdraws into the cylinder housing 24 to contract the hydraulic cylinder device 18. Therefore the tilt-down and trim-down operation of the propulsion unit 13 can be conducted.

In the above-mentioned hydraulic circuit, the down blow valve 66 is connected with the rod side space side fluid space 65B of the shuttle valve device 23, the up blow valve 67 is connected with the piston side space side fluid space 65A, and the thermal blow valve 68 and the manual valve 69 are provided between the second piston side space side channel 45 and the second rod side space side channel 48.

The down blow valve 66 guides the hydraulic fluid corresponding to the volume of the piston rod 31 entering the cylinder 29 (the inner sleeve 25) into the tank device 22 via the fluid storage space 41 at the time the hydraulic cylinder device 18 contracts. The up blow valve 67 guides the excessive hydraulic fluid into the tank device 22 via the fluid storage space 41 when the gear pump 38 still rotates with the hydraulic cylinder device 18 extended even though the buffer piston 27 is in contact with the rod guide 30.

The thermal blow valve 68 exhausts the increased hydraulic fluid in to the tank device 22 via the fluid storage space 41 when the volume of the hydraulic fluid in the piston side space 32A of the hydraulic cylinder device 18, the second piston side space side channel 45, the boosting channel 46 and the boosting space 35 increased by the temperature change. The manual valve 69 is for returning the hydraulic fluid in the piston side space 32A or the rod side space 32B of the hydraulic cylinder device 18 to the tank device 22 via the fluid s torage space 41 manually by the operator for allowing the tilt-up or tilt-down of the propulsion unit 13 manually when the propulsion unit 13 and the tilt-trim device 17 are out of order.

The tilt operation and the trim operation will be explained.

(1) The Trim-up Operation and the Tilt-up Operation

The trim-up operation and the tilt-up operation are conducted by rotating the gear pump 38 shown in FIG. 4 in the forward direction. That is, by the forward rotation of the gear pump 38, the hydraulic fluid is sent into the piston side space 32A via the first piston side space side channel 44, the piston side space side check valve 49 and the second piston side space side channel 45 by pressure so as to force the piston rod 31 in the projecting direction via the buffer piston 27 and the free piston 28. At the same time, hydraulic fluid is sent to the boosting space 35 from the piston side space 32A via the opening 54, the boosting housing path 55, the first space 56 and the first rod guide path 57 of the boosting channel 46 by pressure so as to force the boosting housing 19 toward the projecting direction of the piston rod 31. The hydraulic fluid in the rod side space 32B of the hydraulic cylinder device 18 is returned to the gear pump 38 via the second rod side space side channel 48 (the second rod guide path 61, the second space 62, the housing path 59 and the pump case path 58), the rod side space side check valve 50 and the first rod side space side channel 47.

Accordingly, as shown in FIGS. 2 and 5, the piston rod 31 is forced by pressure in the same direction also from the boosting housing 19 in addition to the pressure from the rod side space 32A via the buffer piston 27 and the free piston 28 so that the sum of the pressures provides the trim-up power for the trim-up operation of the propulsion unit 13 of the outboard motor 10, resisting to the weight and the thrust.

In the final process of the trim-up operation, since the projecting movement of the boosting housing 19 is limited by the contact of the stopper ring 19A with the stopper portion 19B, if the forward rotation of the gear pump 38 further continues, the hydraulic fluid is supplied only to the piston side space 32A so that only the piston rod 31 projects as shown in FIG. 6 to conduct the tilt-up operation of the propulsion unit 13. The tilt-up operation is finished when the buffer piston 27 contacts the rod guide 30.

(2) The Tilt-down Operation and the Trim-down Operation

The trim-down operation and the tilt-down operations are conducted by rotating the gear pump 38 shown in FIG. 4 in the reverse direction. That is, by the reverse rotation of the gear pump 38, the hydraulic fluid is sent into the rod side space 32B via the first rod side space side channel 47, the rod side space side check valve 50 and the second rod side space side channel 48 (the pump case path 58, the housing path 59, the second space 60 and the second rod guide path 61) by pressure, and the hydraulic fluid in the piston side space 32A is returned to the gear pump 38 via the second piston side space side channel 45, the piston side space side check valve 49 and the first piston side space side channel 44 so as to force the piston rod 31 to the storing direction via the buffer piston 27 and the free piston 28. Accordingly, the piston rod 31 conducts the tilt-down operation of the propulsion unit 13 until the shaft supporting portion 34 contacts the boosting housing 19 as shown in FIGS. 6 and 5.

If the reverse rotation of the gear pump 38 shown in FIG. 4 further continues to supply the hydraulic fluid into the rod side space 32B, the piston rod 31 is further stored. As a result, the boosting housing 19 moves in the storing direction of the piston rod 31 and the stopper ring 19A shown in FIG. 5 separates from the stopper portion 19B. The hydraulic fluid in the boosting space 35 reaches to the piston side space 32A via the first rod guide path 57, the first space 56, the boosting housing path 55 and the opening 54 of the boosting channel 46, and returned to the gear pump 38 via the second piston side space side channel 45, the piston side space side check valve 49, and the first piston side space side channel 44. Accordingly, the piston rod 31 is stored and as shown in FIGS. 5 and 2, the trim-down operation of the propulsion unit 13 is finished when the boosting housing 19 contacts with the upper end portion of the rod guide 30.

According to the above-mentioned embodiment, the following effects can be achieved.

(1) Since the hydraulic fluid is supplied from the gear pump 38 of the hydraulic fluid supplying and exhausting device 20 to the piston side space 32A of the hydraulic cylinder device 18 and the boosting space 35 in the trim-up operation, the piston rod 31 is forced by pressure in the projecting direction from the buffer piston 27 and the free piston 28 as well as the pressure in the same direction from the boosting housing 19. Therefore, the sum of the pressure functions on the piston rod 31 as the trim-up power so that a large trim-up power can be provided.

(2) Since the tilt-up power must only lift the weight of the propulsion unit 13 of the outboard motor 10, only a small power is required, and thus the hydraulic cylinder device 18 need not be larger so that the operation speed in the tilt-up operation can be higher.

(3) Since the boosting housing 19 for performing the trim operation is arranged at the outer periphery of the cylinder housing 24, the first piston side space side channel 44, the piston side space side check valve 49, the second piston side space side channel 45 and the boosting channel 46 (the opening 54, the boosting housing path 55, the first space 56 and the first rod guide path 57) for supplying or exhausting the hydraulic fluid from the gear pump 38 of the hydraulic fluid supplying and exhausting device 20 to the boosting space 35 of the boosting housing 19 are formed inside the cylinder housing 24 and the first pump case 36, the first piston side space side channel 44, the piston side space side check valve 49 and the second piston side space side channel 45 for supplying or exhausting the hydraulic fluid from the gear pump 38 to the piston side space 32A are formed inside the cylinder housing 24 and the first pump case 36, further, the first rod side space side channel 47, the rod side space side check valve 50 and the second rod side space side channel 48 (the pump case path 58, the housing path 59, the second space 60 and the second rod guide path 61) for supplying or exhausting the hydraulic fluid from the gear pump 38 to the rod side space 32B are formed inside the cylinder housing 24 and the first pump case 36, the piping is not exposed outside the tilt-trim device 17, and thus the tilt-trim device 17 can be downsized.

(4) Since the piping is not exposed outside the tilt-trim device 17 as mentioned above, the piping damage accident can be prevented.

(5) Since the cylinder 29 for sliding the buffer piston 27 and the free piston 28 is provided by the inner sleeve 25 arranged in the cylinder housing 24, and the inner sleeve 25 is produced by a drawn pipe material, the inside of the inner sleeve 25 is formed like a mirror at the time of the production. Therefore, a mirror processing of the inside 53 of the cylinder housing 24 is not required so that the production time in the processing of the hydraulic cylinder device 18 can be cut back and the cost can be reduced.

(6) Since the buffer piston 27 contacts the inner sleeve 25 having a diameter substantially the same as the inner diameter of the inside 53 of the cylinder housing 24, the outer diameter of the buffer piston 27 is substantially the same as the inner diameter of the inside 53 of the cylinder housing 24 so that the pressure-receiving area thereof can be larger. As a result the buffer energy functioning on the piston rod 31 can preferably be absorbed so that the shock-absorbing function can be improved.

Although the above-mentioned embodiment comprises the inner sleeve 25 and the outer sleeve 26 in the cylinder housing 24 shown in FIG. 2, it is also possible to use only the inner sleeve 25 in the cylinder housing 24, with the space between the inner sleeve 25 and the inside 53 of the cylinder housing 24 communicating with the boosting housing path 55 and the first rod guide path 57 instead of the first space 56 as a part of the boosting path 46 and the housing path 59 shown in FIG. 3 communicates directly with the second rod guide path 61 shown in FIG. 2.

As heretofore mentioned, according to the tilt-trim device for a marine propulsion device of the present invention, a large trim-up power can be provided with a compact device configuration, and further, damage of the device, particularly of the piping can be prevented.

While the preferred embodiments of the invention have been described in detail with reference to the drawings, they are by no means limitative, and various changes and modifications are possible without departing from the scope and spirit of the invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A tilt-trim device for a marine propulsion unit supportably mounted to a mounting bracket, said device provided between said mounting bracket and said propulsion unit, comprising:

a cylinder device having a longitudinal axis and comprising a cylinder housing having an inner cylindrical sleeve situated therein, said inner cylindrical sleeve filled with a working fluid and a piston having a piston rod, which said piston is slidably provided within said sleeve so as to divide said cylinder housing into a piston side space and a rod side spacer;

a boosting housing slidably provided about an outer periphery of said cylinder housing so as to form a liquid impervious boosting space with said cylinder housing, said boosting housing coaxial with and contacts an end of said piston rod;

a working fluid supplying and exhausting device intergrally formed with said cylinder housing for supplying a working fluid alternatively to one of said piston side and boosting spaces, and said rod side space, during an extension or compression of said piston rod from said cylinder housing, said cylinder housing including a channel connecting said working fluid supplying and exhausting device and said boosting space, whereby a pressure force is indirectly applied to the piston rod in a rod extension direction during a supplying of the working fluid from said working fluid supplying and exhausting device to said boosting space through said channel.

2. The tilt-trim device for a marine propulsion device according to claim 1, wherein the channel for connecting said working fluid supplying and exhausting device and the piston side space or the rod side space is formed inside the cylinder housing.

3. The tilt-trim device for a marine propulsion device according to claim 1, wherein said inner cylindrical sleeve provided in the cylinder housing creates a space between the sleeve and said cylinder housing wherein said space forms a part of the channel for connecting the working fluid supplying and exhausting device and the boosting space.

4. The tilt-trim device for a marine propulsion device according to claim 2, wherein said inner cylinder sleeve provided in the cylinder housing creates a space between the sleeve and said cylinder housing wherein said space forms a part of the channel for connecting the working fluid supplying and exhausting device and the boosting space.

5. The tilt-trim device for a marine propulsion device according to claim 1, further including an outer cylindrical sleeve, said outer sleeve provided in said cylinder housing, concentrically of said inner cylindrical sleeve, wherein a space exists between said inner sleeve and said outer sleeve, said space forming a part of the channel for connecting the working fluid supplying and exhausting device and the boosting space and wherein a space between said outer sleeve and said cylinder housing forms another part of the channel for connecting said working fluid supplying and exhausting device and said rod side space.

6. The tilt-trim device for a marine propulsion device according to claim 2, further including an outer cylindrical sleeve, said outer sleeve provided in said cylinder housing, concentrically of said inner cylindrical sleeve, wherein a space exists between said inner sleeve and said outer sleeve, said space forming a part of the channel for connecting the working fluid supplying and exhausting device and the boosting space and wherein a space between said outer sleeve and said cylinder housing forms another part of the channel for connecting said working fluid supplying and exhausting device and said rod side space.

* * * * *